United States Patent [19]

Cano

[11] Patent Number: 4,774,108

[45] Date of Patent: Sep. 27, 1988

[54] METHODS OF FORMING AND USING MAT TO OBTAIN SURFACE FINISHES

[76] Inventor: Arq C. C. Cãno, CDA. Bosques de Moctezuma #35, 3a Seccion Fracc. Herradura, Huixquilucan edo de Mexico, Mexico

[21] Appl. No.: 848,248

[22] Filed: Apr. 4, 1986

[51] Int. Cl.[4] ..... B05D 5/00; B21F 27/02; B21F 27/12

[52] U.S. Cl. ..... 427/262; 140/71 R; 140/92.1; 140/107; 427/282; 427/401

[58] Field of Search ..... 140/71 R, 92.1, 107; 427/262, 263, 267, 268, 282, 401; 428/207, 209, 210

[56] References Cited

U.S. PATENT DOCUMENTS

| | | | |
|---|---|---|---|
| 2,266,926 | 12/1941 | Vida | 427/282 X |
| 3,019,127 | 1/1962 | Czerwonka et al. | 428/338 |
| 3,175,331 | 3/1965 | Klein | 51/400 |
| 3,340,087 | 9/1967 | Mazzola | 427/282 X |
| 3,712,825 | 1/1973 | Yocum | 427/264 |
| 3,979,542 | 9/1976 | Perantoni et al. | 428/204 |
| 4,105,734 | 8/1978 | Nakagawa | 264/132 |
| 4,135,020 | 1/1979 | Maxwell | 428/131 |
| 4,239,820 | 12/1980 | Salvador | 427/272 |

FOREIGN PATENT DOCUMENTS

| | | | |
|---|---|---|---|
| 2555916 | 6/1985 | France | 472/282 |

*Primary Examiner*—Evan K. Lawrence

*Attorney, Agent, or Firm*—Norvell & Associates

[57] ABSTRACT

Improved techniques are provided for obtaining a desirable surface finish of two or more visually distinct selected colors. A mat is prepared by selectively weaving wire between fixed pins on a board. Once removed from the pins, the mat may be molded about the surface of an object painted a first selected color. A second color is then applied over the mat and the object, resulting in a desired dual-color finish after the mat is removed. The techniques of the present invention are particularly well suited for obtaining a high quality marble-like finish on objects of various sizes, shapes, and materials.

16 Claims, 2 Drawing Sheets

METHODS OF FORMING AND USING MAT TO OBTAIN SURFACE FINISHES

FIELD OF THE INVENTION

The present invention relates to techniques and materials for obtaining a high quality surface finish of two or more colors, and more particularly relates to the formation of a unique malleable mat for obtaining such high quality finishes.

BACKGROUND OF THE INVENTION

Finishes having two or more visually distinct colors have long been recognized to enhance the value of certain objects. In many instances, however, such techniques are difficult to utilize, and are accordingly both expensive and infrequently used. Other finishes obtainable, for example, from various commercially available kits produce a surface finish which either looses its attractive appearance with age and/or use, and thus is generally applied only to objects of marginal or low value.

One of the more desirable dual color finishes is a natural or suedo marble finish. Marble or marble-like finishes on vases, fountains, statues, table tops, and other items typically represent a high quality and expensive product. Unfortunately, such items made from marble are very expensive, while available techniques for obtaining marble-like finishes result in a finish of relatively poor quality, and are thus perceived as being "fake" items.

U.S. Pat. No. 2,266,926 is directed to forming a marble-like pattern on objects. A silk mat is utilized to be applied over the object prior to the application of the second color. U.S. Pat. No. 3,340,087 is directed to a mechanized process of producing a marble-like finish. A metallic wool material is utilized to create the dual-color surface pattern of the marble-like finish. As previously suggested, such mats formed from randomly positioned strands of silk or steel do not result in a high quality finish which closely resembles natural polished marble.

Depending on the material of the object to be finished, other prior art pseudo-marble finishing techniques provide finishes which are, at best, of marginally acceptable quality. Accordingly, such techniques have not been widely accepted by the public, and are generally used only for relatively poor quality objects which offer the buyer a cheap imitation of real marble products. Also, if such prior art techniques are applied to objects of different materials, such as wood, metal, or plastic, the quality of the finish may be even further sacrificed. Moreover, objects having substantially non-planar surfaces often cannot be finished with a pseudo-marble appearance because the mat utilized cannot be made to sufficiently conform to the configuration of the surface to be painted.

Problems similar to those described above with respect to obtaining a high quality marble-like finish are also applicable to prior art techniques for obtaining a wood-grain type finish or a high quality antiquing finish. The disadvantages of the prior art are, however, overcome by the present invention, and improved methods and apparatus are hereinafter described for obtaining a high quality finish of two or more visually distinct colors.

SUMMARY OF THE INVENTION

Improved methods and apparatus are provided for forming a desirable finish of two or more visually distinct colors on a selected object. The techniques of the present invention may be utilized to obtain a high quality marble-like finish on various objects fabricated from clay, wood, plastic, fiberglass, metal, glass, plaster or concrete.

The present invention employs a malleable mat fabricated of thin wire to a desired size and shape. The mat may be formed on a board having upright pegs spaced intermittently about the perimeter of the desired shape. The wire is first tied to one peg, then selectively wound about an opposing peg, and similarly criss-crossed until a mat is formed in the area between the pegs. During this criss-crossing process, wire is selectively strung from a first peg to an intermediate wire, and thence to a second peg somewhat adjacent the first peg, thereby breaking the continuinty of straight wires in the mat. Once formed and secured, the mat may be removed from the pegs and a further selective adjustment made of the position of selected wires relative to other wires.

After the surface of the object to be finished is prepared, a first selected color is applied by spraying onto the object and allowed to dry. Thereafter, the mat as formed above is applied over the painted object and, if necessary, the mat is molded to substantially conform to the configuration of the object. A second selected color is then sprayed onto the mat and the object, and the mat is then removed. Once the dual-color finish is dried, a transparent lacquer may be applied before the final finish is given to the surface.

Accordingly, it is a feature of the invention to provide a method of forming a high quality finish of two or more visually distinct colors on an object.

It is also a feature of the invention to provide a method of forming a high quality finish which may be used for objects of various sizes, shapes, and materials.

It is another feature of the invention to provide a malleable mat for forming a high quality finish of two or more colors, wherein the mat is fabricated by selectively winding a wire between pegs on the board, and between pegs and intermediate wires.

Finally, it is a feature of the present invention to provide methods and apparatus for forming a painted finish of two or more colors which does not appear to be painted by conventional techniques.

These and other features and advantages of the present invention will become apparent from the following detailed description, wherein reference is made to the Figures in the accompanying drawings.

DETAILED DESCRIPTION OF THE INVENTION

The present invention may be used to form a painted surface of two or more visually distinct colors on any number of objects of various sizes, shapes, and materials.

The techniques of the present invention may be utilized to form a desired finish on a relatively planar surface (such as a desk top), and elongate strips of material (such as moldings), and three dimensional ornamental or utilitarian objects (such as telephones, statues, animal replicas or water fountains), an artistic products (such as lamp bases or vases), and numerous other products. In particular, the techniques of the present invention may be used for any object which may be painted, and are particularly well suited for objects of substantial aesthetic value. The techniques of the invention are well suited to products made from wood, plastic, metal, fiberglass, clay, plaster, glass, concrete, or other commonly painted materials.

The teachings of the present invention produce a high quality surface having two or more visually distinct colors. Modifications may be made to vary the appearance of the finish, as explained hereafter. Particularly, the teachings of the present invention may be used to form a high quality marble-like surface, a surface having a natural wood grain appearance, a surface having an antique appearance, or a surface with a finish resembling a turtoise shell. The selection of the colors according to the invention is at the discretion of the user, although high quality and aesthetically pleasing surfaces frequently result from a selection of colors including black and a relatively dark color, e.g., dark green, dark blue or dark red, or from the selection of two shades from the same color, e.g., light brown and dark brown, light blue and dark blue.

MAT FORMATION

Figure 3:
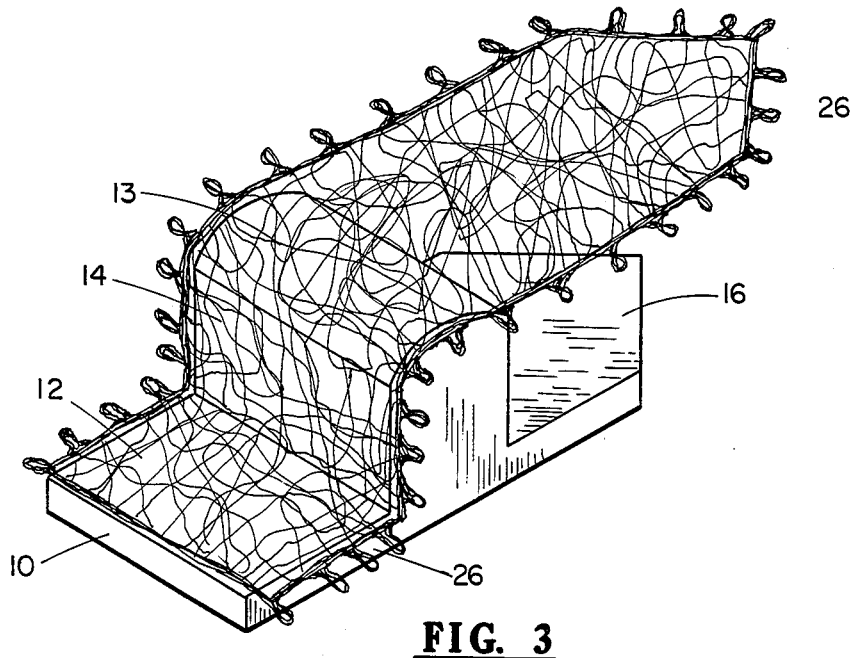
FIG. 3 is a pictorial view of an object to be painted according to the present invention with a portion of a mat shown covering the surfaces to be painted.

The teachings of the present invention include the formation and utilization of a malleable mat. This mat may be formed on a planar surface, such as a board, or on a surface contour approximating the contour of the object to be painted. As shown in FIG. 3, object 10 has a relatively flat surface 12, an upwardly projecting portion with a curvalinear top 13 and sides 14 perpendicular to surface 12, and a triangle-shaped flat surface 16. Since the mat of the present invention is malleable, it should be understood that a relatively flat mat may be bent along the outer surfaces of the object in order that the mat may subsequently obtain a contour approximating the contour of the surfaces to be painted.

Accordingly, the mat for assisting in preparation of the painted surfaces for object 10 may be fabricated on a flat board 18 fabricated from, e.g., $\frac{1}{4}''$ plywood. A plurality of pegs 20 are affixed to the board 18, and extend upward from a horizontally positioned board. Pegs 20 may be formed from wood, metal, or plastic, and typically are cylindrical in configuration. According to one embodiment, pegs 20 are nails extending through the thickness of board 18, with the nail heads being raised above the top surface shown in FIG. 1. As explained subsequently, a mat having an area approximating the area to be painted is desired, although preferably the mat will be slightly larger than the area to be painted. To form a substantially planar mat, pegs 20 may be positioned about the perimeter of the desired mat area. Although the spacing of the pegs is not critical, a high quality marble-like finish results when pegs 20 are spaced from between $\frac{1}{4}'$ to 1 $\frac{1}{4}''$, and preferably from $\frac{5}{8}''$ to $\frac{3}{4}''$, about the perimeter of the desired mat area.

Malleable wire is preferably used to form the mat according to the present invention, and copper wire having a mean diameter of 0.012" to 0.018" is preferable. Wire 22 can be unwound from a spool (not shown) and first tied to one peg, e.g. 20A. The wire is then extended to and wrapped around peg 20B, and then consecutively to pegs 20C, 20D, 20E, and 20F, forming substantially straight wire segments 22A–B, 22B–C, 22C–D, 22D–E, and 22E–F, as shown. Wire is thus run from one peg to a selected peg substantially opposite thereto, thereby forming a mat-like substance. If desired, however, the wire may intermittedly be extended from one peg, e.g., peg 20G, to a peg not opposite but substantially adjacent that peg, e.g., to peg 20E. This technique may be utilized intermittedly to strengthen the rigidity of the perimeter of the mat, and enables the wire to subsequently extend from a more preferable peg, e.g., peg 20E.

Figure 1:
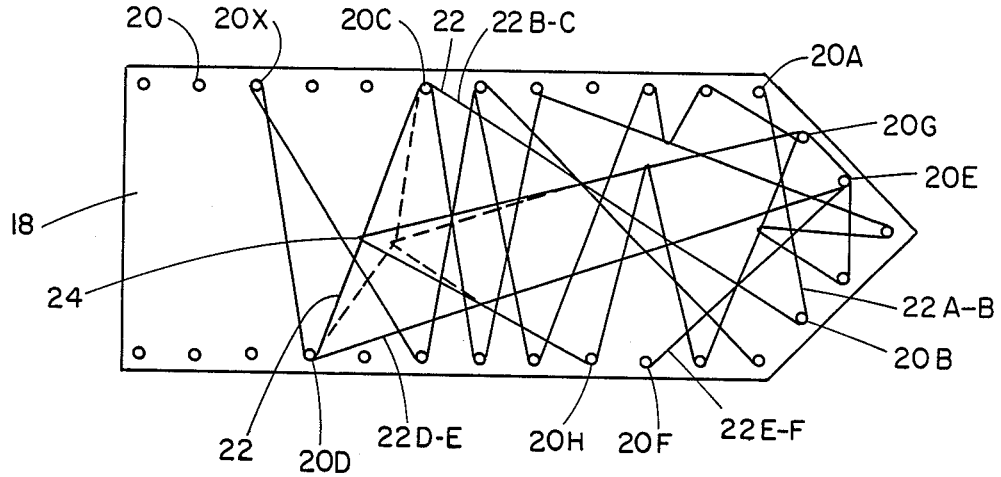
FIG. 1 is a top view of a board containing a plurality of pegs according to the present invention, with wire being strung to form an initial portion of a mat.
Figure 2:
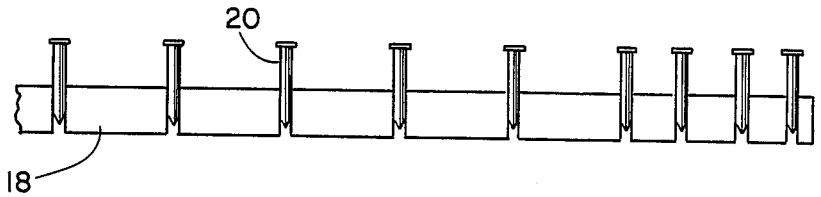
FIG. 2 is a side view of the board shown in FIG. 1.

It is a particular feature of the present invention, however, to selectively disrupt the continuity of the straight wire segments or "destroy" the straight lines that extend between opposite pegs. Accordingly, FIG. 1 depicts that the wire segment extending from 20H extends to wire 22C–D. The wire may be wound around or tied by knot 24 to segment 22C–D, and extend from knot 24 to a selected peg 20G. In this case, peg 20G should be understood to be either a peg opposite peg 20H, or a peg substantially adjacent peg 20H. In either case, the crosscross pattern of the wire is continued. When the wire is pulled toward peg 20G, straight line segment 22C–D will be "broken", i.e., the wire of 22C–D will bend somewhat in a manner similar to the dashed lines shown in FIG. 1. In a similar manner, wire 22 may continue to be wound to new or previously employed pegs, and selectively interconnected to existing wire segments by knots 24. Thus, the wire may be unwound from the spool and continue to extend from one peg to another peg, or from one peg to an existing wire within the mat and then onto another peg in order to form the mat.

Although completion of the mat is somewhat subjective, a typical mat according to the present invention will generally have no open area (an area without any wire within that area), of no greater than approximately $\frac{1}{2}''$ by $\frac{1}{2}''$, and generally less than approximately $\frac{3}{8}''$ by $\frac{3}{8}''$. The wire density within a typical mat is such that the mat would generally have from 15" to 36", and preferably from 25" to 28" of wire length per square inch of mat. Similarly, the number of knots 24 or interconnections of a wire to existing wire within the mat rather than to an opposing peg is also somewhat determined by subjective criteria, although the number of such knots for interconnections (not counting knots to the pegs) is generally from four to ten, and preferably from six to eight knots per 25 square inches of mat. Thus, it should be understood that although FIG. 1 depicts only the beginnings of a mat, a mat may be easily formed by continuing the process described above until the mat is complete.

Figure 4:
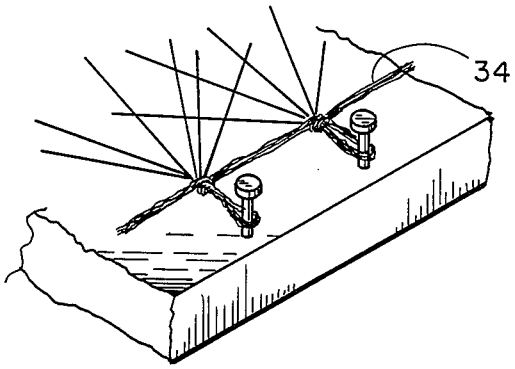
FIG. 4 is a top view of an edge of a suitable mat according to the invention.

Once the desired density of the mat is obtained, the wires to each peg should be tied off to secure the mat once the pegs are removed. Referring to FIG. 4, wire is thus wrapped around each of the wires leading to a peg, and that loop of wire is then snugly tied in a knot closely adjacent the peg to hold the wires substantially in place. The wires to each peg are similarly tied off in this manner. An edge portion of a mat formed adjacent two pegs is shown in FIG. 4, with wire 34 being used to tie off the peg wires to secure the edge of the mat once removed from the pegs.

In order to remove the mat from the board 18, the mat may be slowly lifted upward to slide the mat off the pegs 20. Also, if nails are used to form the pegs, the nails may be pulled from the board, thus leaving the mat on the board to be easily removed. In either case, removal of the mat from the pegs will further destroy the straight line segments, since tension in the wire segments cannot exist once the mat is removed from the pegs. Finally, it may be preferable to even further destroy the straight line segments by bending and reforming the malleable mat by simple manual manipulation. Since the mat is flexible, it should be understood that the mat formed according to the techniques described above may then be easily configured to conform substantially to the surfaces 12, 13, 14, and 16 of the object shown in FIG. 3.

MATERIAL PREPARATION AND PAINTING OF THE UNDERLYING COAT

As previously indicated, an underlying coat is applied to the object prior to utilization of the mat described above to form the desired finish according to the present invention. As customary with conventional painting techniques, the object to be painted may first be sanded, unless the surface contains no rough areas. In the case of wood, fiberglass, plastic, and clay materials, dry sanding with number 120 grit paper is customary; in the case of metal goods, wet sanding with number 240 grit paper is customary. After sanding, defects on the surface will generally become more noticeable than before sanding. Holes, cracks, or other defects on the object's surface may be repaired with, for example, an appropriate filling agent. A fine coarse grain filler mixed with primer or gum lacquer is customarily utilized for wooden products; metal, fiberglass, clay, or plastic goods may typically be repaired with DuPont Pirocilin filler.

After sanding the filled joints and cracks to the smoothness of the object generally, several layers of primer may then be applied with a spray gun. As is conventional for quality spray finishes, the primer may be mixed with an equal proportion of thinner prior to spraying and, after drying, the surface is again sanded with number 240 grit paper. In the case of wooden materials, it has been found preferable after the sanding operation to manually polish the surface using, for example, a cotton ball coated with a mixture of primer and thinner.

Once the surface has been properly primed, the selected color of base paint is applied, preferably by spraying. The base color may similarly be cut with thinner, and generally two or three spray applications are preferable to completely and uniformly cover the surface. At this stage, the object will therefore resemble a conventional high-quality painted object.

APPLICATION OF OVERLYING PAINT

The mat as described above is utilized in the step of spraying the second color paint on the object. Very thin wire is utilized to form the mat, and it is preferable to spray two or more layers on lacquer on the mat before applying a mat to the object. The mat as prepared above may then be manually molded to substantially conform to the surface shape of that portion of the object to be painted with the second color paint. As shown in FIG. 3, therefore, object 10 will have been prepared and painted with the base color as described above. Mat 26 is then laid on the top surface 12 to be painted, and the mat is bent so that the perpendicular side 14 and curvalinear top surface 13 to be painted are similarly covered. Preferably, the mat 26 is slightly larger than the surface to be painted, since the perimeter of the mat contains wire previously wound around pegs, and this perimeter of the mat would therefore not produce the same effect as that produced by that portion of the mat covered by areas 12, 13, 14, and 16.

Once the mat is applied over that portion of the object to be painted a second color, the second color of paint is applied, preferably by spraying, over the mat and onto the surfaces 12, 13, 14, and 16. Again, this second color of paint is generally cut with equal amounts of primer. During the spraying operation, which again may take two or more coats, the mat 26 is not moved with respect to the object. The mat may be removed from the object after the second color of paint has dried on both the mat and the object.

It should be understood that the mat may be reused for additional spraying applications, either on the same or a different object. If necessary, the malleable mat may be formed to a new shape or used to paint another portion of the object. The same mat may be used for several second coat applications without cleaning. If too much paint accumulates on the mat, the appearance of the finish will be altered, and the mat may therefore be cleaned or stripped of accumulated paint with thinner or other stripping material, than reused in the manner as described above.

FINISHING OPERATIONS

Once the mat has been removed from the object, one or more layers of transparent lacquer may be sprayed onto the object in order to protect the desired dual-color finish. After the transparent lacquer dries, it may be dry sanded with number 600 grit paper. If the painted object was wooden, this sanded surface may again be manually polished with a cotton ball coated with a mixture of transparent lacquer and thinner. Preferably, this polishing operation is performed in consecutively perpendicular directions to obtain the desired high-polished appearance.

Figure 5:
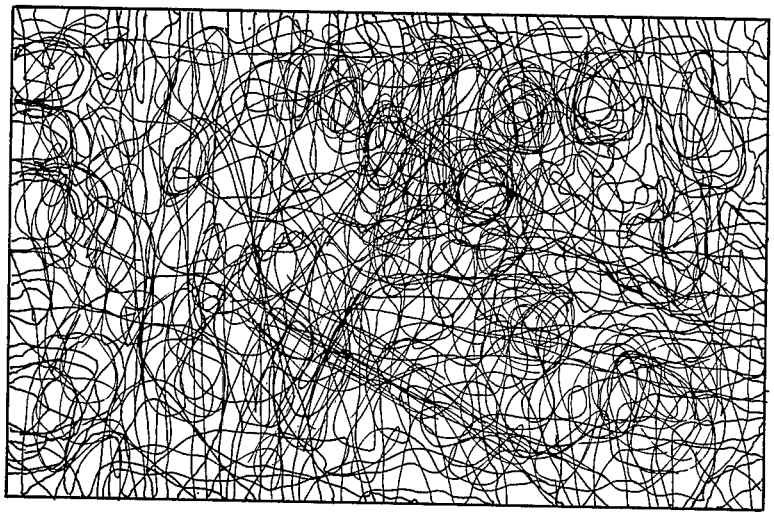
FIG. 5 is a top view of a painted surface according to the present invention.

The surface as prepared above may subsequently be polished with a cloth coated with a commercial polishing compound, such as Brasso. If desired, the cloth may first be moistened with gasoline to better enable the cloth to easily slide over the surface, and then applying the rubbing compound on the cloth and polishing the surface in a conventional manner. Once polished, a layer of conventional furniture polish (silicon oil) may be applied, and the surface then cleaned with a cloth. A picture of a finished surface 28 according to the present invention of two colors 30 and 32 is shown in FIG. 5.

The techniques of the present invention are preferably utilized to obtain a spray painted surface of two visually distinct colors. It should be understood, however, that the concepts of the present invention may be utilized to similarly form a painted surface of more than two colors. In other words, after the base coat has been applied, the mesh may be applied over the object and the object painted a second color. Once this surface has dried and is sanded, a same or a different mat may be reapplied over the surface, and the individual wires of the mat would normally not occupy the same position previously held when the second color of paint was applied. With the mat reapplied this second time, the mat and object may then be painted a third color. Similarly, additional colors of paint may be applied utilizing the mat of the present invention. Once the final layer of paint has been applied, the surface finishing operations as described above may then occur.

Depending on the configuration of the object to be painted, it may be difficult to apply a mat formed in a plane uniformly over a relatively large irregularly shaped object. Even though the mat is flexible, such a flat mat cannot be practically deformed to uniformly cover very erratic shapes. In such cases, it may be necessary or beneficial that the mat be formed on an object which more closely resembles the surface configuration of that portion of the object to be painted. If, for example, the mat has to cover a large curvilinear surface, it may be preferable that the mat according to the present invention be formed on a device that has an outer configuration substantially identical to the object to be painted.

These and other features and advantages of the present invention will be apparent from the specific embodiments disclosed herein. Accordingly, the apparatus and methods as described herein should be understood as exemplary of the invention, and not as limitations thereto.

What is claimed is:

1. A method of forming a surface finish on an object of two or more visually distinct colors, the method comprising:

connecting a length of wire selectively between a plurality of pegs to form substantially straight line wire segments of a malleable mat;

connecting the same or another length of wire between a peg and one or more straight line wire segments and then to another peg to disrupt one or more of said substantially straight line wire segments thereby forming said mat;

painting said object with an underlying coat of a first color;

removing said mat from said pegs and placing said mat over an area of said object painted said first color;

spraying said area with an overlying coat of a second color while said mat covers said area; and removing said mat from said area.

2. The method as defined in claim 1, further comprising:

forming said mat from copper wire having a diameter of from 0.012 inches to 0.018 inches.

3. The method as defined in claim 1, further comprising:

selectively deforming and reforming said mat to further disrupt said substantially straight line segments prior to placing said mat over said area.

4. The method as defined in claim 1, further comprising:

deforming said mat to substantially conform to the configuration of said area.

5. The method as defined in claim 1, further comprising:

selectively connecting said wire from one peg toward an adjacent peg to increase the stiffness of the periphery of said mat.

6. The method as defined in claim 1, further comprising:

smoothing the surface of said object; and thereafter spraying said object to form said underlying coat of paint.

7. The method as defined in claim 1, further comprising:

repeatedly using said mat to cover another area of said object or an area of another object during additional spraying operations; and selectively stripping accumulated paint from said mat between repeated uses.

8. The method as defined in claim 1, comprising:

forming said mat in a substantially single plane on said plurality of pegs.

9. A method of forming a malleable wire mat of the type intended for covering a surface to be spray painted, said method comprising:

(a) providing a plurality of spaced-apart pegs substantially defining an area between said pegs;

(b) connecting a continuous length of wire to a selected one of said pegs;

(c) repeatedly interconnecting said wire to substantially opposing pegs to form substantially straight line wire segments in said area between said pegs;

(d) selectively interconnecting the same or another wire from one of said pegs to a selected existing substantially straight line wire segment and thereafter to another of said pegs to disrupt the continuity of said straight line wire segments;

(e) continuing steps (c) and (d) to form a mat substantially covering said area between said pegs; and (f) removing said mat from said pegs.

10. The method as defined in claim 9, wherein steps (c) and (d) are continually repeated until said mat has a wire length density of from 15 inches to 36 inches per square inch of mat.

11. The method as defined in claim 9, wherein steps (c) and (d) are continued until open areas of said mat containing no wire lengths are less than approximately $\frac{3}{8}$ inch by $\frac{3}{8}$ inch.

12. The method as defined in claim 9, further comprising:

selectively interconnecting said wire from a peg toward an adjacent peg to substantially increase the density of wire along the perimeter of said mat.

13. The method as defined in claim 9, further comprising:

selectively spacing said pegs from $\frac{1}{4}$ inch to $1\frac{1}{4}$ inches from adjacent pegs.

14. The method as defined in claim 9, further comprising:

selectively positioning said pegs to define said area of said mat greater than an area to be subsequently painted.

15. The method as defined in claim 9, further comprising:

positioning said pegs on a substantially flat board; and deforming said mat removed from said pegs to substantially conform to the configuration of said area to be painted.

16. The method as defined in claim 9, further comprising:

positioning said pegs on an object having substantially the configuration of said surface to be painted.

* * * * *